US007154493B2

(12) United States Patent
Yee

(10) Patent No.: US 7,154,493 B2
(45) Date of Patent: Dec. 26, 2006

(54) MONITOR INTERCONNECT COMPENSATION BY SIGNAL CALIBRATION

(75) Inventor: Dawson Yee, Clyde Hill, WA (US)

(73) Assignee: Microsoft Corporation, Redmond, WA (US)

( * ) Notice: Subject to any disclaimer, the term of this patent is extended or adjusted under 35 U.S.C. 154(b) by 562 days.

(21) Appl. No.: 10/386,436

(22) Filed: Mar. 13, 2003

(65) Prior Publication Data

US 2004/0196280 A1 Oct. 7, 2004

(51) Int. Cl.
*G09G 5/00* (2006.01)

(52) U.S. Cl. ..... 345/211; 345/213; 348/189

(58) Field of Classification Search ..... 345/204–213; 348/180–183, 189–192, 536
See application file for complete search history.

(56) References Cited

U.S. PATENT DOCUMENTS 4,342,029 A * 7/1982 Hofmanis et al. ..... 345/22
4,922,328 A * 5/1990 Engel et al. ..... 348/180
5,546,098 A * 8/1996 Moriconi ..... 345/3.1
5,987,624 A 11/1999 Eglit et al.
6,437,829 B1 8/2002 Webb et al.

FOREIGN PATENT DOCUMENTS

EP 0896318 A2 2/1999

OTHER PUBLICATIONS

Monitor Timing Specifications, VESA and Industry Standards and Guidelines for Computer Display Monitor Timing, Version 1.0, Revision 0.8, Adoption Date: Sep. 17, 1998, Video Electronics Standards Association.

* cited by examiner

*Primary Examiner*—Alexander Eisen
(74) *Attorney, Agent, or Firm*—Banner & Witcoff, Ltd.

(57) ABSTRACT

To improve the performance of a standard monitor interconnect, e.g., a VGA monitor interconnect, a display adaptor of a computer device generates reference signal patterns which are used to calibrate the signals received by an interconnected display monitor. The monitor receives the reference signal patterns from the computer over the interconnect with the analog display signals, e.g., during the blanking intervals of the signals, and adjusts the signals based upon a detected deviation of the reference signals from corresponding control values. In one embodiment, the computer device generates and sends reference signal patterns if it receives from the monitor confirmation that it is equipped to perform calibration based upon received reference signal patterns, and operates normally (without reference signal pattern generation) otherwise.

19 Claims, 6 Drawing Sheets

MONITOR INTERCONNECT COMPENSATION BY SIGNAL CALIBRATION

FIELD OF THE INVENTION

The present invention relates generally to the improvement of monitor interconnect performance. More particularly, the invention relates to methods and apparatus for calibrating analog signals received by a computer monitor via a monitor interconnect, to thus allow improved monitor interconnect performance while retaining a standard connector form factor.

BACKGROUND

The VGA (video graphics array) analog monitor interconnect scheme has been adopted for use by virtually all personal computer (PC) systems in use today. Various efforts to replace this interconnect scheme have emerged and failed. The market continues to use this type of monitor interconnect because of its low-cost, ubiquity in the installed base, and its general ability to perform.

The existing VGA analog monitor interconnect scheme in wide use today transmits three analog display signals (R, G and B), two reference digital signals (HSYNC and VSYNC), and a few miscellaneous digital control signals. The common connector used on both ends of the standard interconnect cable is a 3 row 15 pin D-sub connector. Physical monitor interconnect performance limitations result in frequency dependent degradation, amplitude mismatches, delay mismatches, and crosstalk of the analog R, G and B signals. Such signal degradation and variability is generally tolerable for CRT and LCD monitors having a resolution in the range of up to 3 megapixels (400 MHz bandwidth). However, the demands on monitor interconnect performance have begun to rapidly increase as screen resolution has increased to beyond 3 megapixels. Existing standard monitor interconnect schemes are becoming a limiting factor with respect to efforts to provide enhanced computer user experiences and meeting increasing user expectations.

Previous proposals for achieving a higher level of interconnect performance use a different connector form factor (e.g., Molex Micro-cross), or use different electrical signaling (e.g., DVI uses digital signaling), that are not compatible with the huge installed base of analog 3 row 15 pin D-sub connectors (VGA). Such proposals have resulted in consumer confusion and frustration, market fragmentation and low adoption.

FIG. 1 depicts a conventional arrangement of a host computer 1 and display monitor 3. Interconnecting these components is a standard interconnect cable 5, in the case of the VGA connector standard, a cable equipped at the host computer end with an analog 3 row 15 pin D-sub connector.

FIG. 2 depicts a prior art display adapter 7, such as a VGA display adapter, included within conventional host computer 1. Display adapter 7 includes a graphics controller 9, which provides digital signals (display data 11, DAC BLANK signal 13, and DOT clock 15) to a Random Access Memory/Digital to Analog Converter (RAMDAC) 17, including in RAM a color look-up table. Data for each pixel of the display is transmitted synchronously with the DOT clock. RAMDAC 17 converts the received digital signals into digital color values using the color look-up table stored in RAM, and converts the digital color values to analog signals (red (R), green (G) and blue (B) signals 19, 21 and 23, respectively) for output to the display circuitry 25 of computer monitor 3 over associated signal lines of standard (e.g., VGA) interconnect 5. DAC Blank signal 13 causes RAMDAC 17 to suppress the R, G and B signals 19, 21 and 23 during horizontal and vertical blanking intervals, in synchronization with the display synch pulses HSYNCH 27 and VSYNCH 29. Display synch pulses HSYNC 112 and VSYNC 114 are provided by graphics controller 9 to the computer monitor directly, also over interconnect 5.

Computer monitor display circuitry 25 is configured to receive the analog R, G and B signals (19, 21 and 23, respectively) and HSYNC 25 and VSYNC 27 signals from host computer 1 and to utilize those signals for creating a corresponding display (e.g., in the case of a CRT monitor, through controlled activation and deflection of R, G and B scanning electron beam guns).

FIG. 3 is an illustrative representation of a scanning procedure for a CRT computer monitor 31. The path of an electron beam 33 (representative of three separate beams that would be provided, one for each of the R, G and B colors) sweeps across a phosphor coated screen in a horizontal line, beginning at the top left corner of the screen. Upon reaching the end of a horizontal line, a return trace or retrace 35 occurs, during which the R, G and B electron beams are blanked so that no image information is transmitted and no mark appears on the screen during the retrace. The electron beam then sweeps across the screen along the next horizontal line, followed by another horizontal retrace. Ultimately, the path of the electron beam moves along the bottom horizontal line of the screen, completing a full sweep of the screen, known as a field. (In the case of interlaced monitors, the electron beams scan only every other line within each field, filling in the skipped lines in a subsequent field.) The completion of each field is followed by a vertical retrace 37, during which the R, G and B electron beams are again blanked such that no image information is transmitted and no mark appears on the screen during the vertical retrace. The time period for horizontal retrace 35, during which the electron beams are also blanked, is known as the horizontal blanking interval. The time period for vertical retrace 37, during which the electron beams are blanked, is called the vertical blanking interval. The timing of the electron beam gun horizontal and vertical retraces (and the associated blanking intervals) are established in relation to horizontal and vertical synch pulses HSYNCH 27 and VSYNC 29, respectively.

LCD displays operate on different principals, not involving raster scanning or actual vertical or horizontal retraces. Instead, color LCD displays rely upon selective application of charges to cells of a liquid crystal panel utilizing a matrix of transistors, which in turn govern the extent to which red, green and blue components of light emanated from behind the computer's display panel are transmitted through the material of the liquid crystal panel at any given point (pixel). To retain compatibility with the huge installed base of the conventional analog VGA monitor interconnect, LCD display monitors generally accept analog input signals.

The usability of the standard VGA interconnect for high resolution monitor applications is limited by the usable bandwidth of the standard analog 3 row 15 pin D-sub VGA connection. Potential exists for increasing the usable bandwidth through improvements in the physical structure of the interconnect itself, e.g., improved shielding and impedance control, but these approaches have inherent constraints. The improvements obtainable are incremental and, in addition, physical improvements (even those that retain the 3 row 15 pin D-sub form factor), would require validation and adoption by suppliers. An approach with the potential for providing substantial gains in usable bandwidth of the VGA (and generally any other standard) interconnect form factor, not reliant on physical changes to the interconnect, would be highly desirable.

SUMMARY OF THE INVENTION

The present invention addresses the above-mentioned need by providing an apparatus and a method by which a computer monitor may calibrate received analog display signals based on reference signal patterns transmitted with the analog display signals, e.g., in the vertical blanking interval thereof. Adjustments to the display signals can be made substantially continuously during normal operation of the monitor (i.e., "on-the-fly"), to thereby increase the usability of standard monitor interconnects for driving high resolution monitors at their higher available resolutions. This is in contrast to existing monitor arrangements, wherein there is no monitor receiver adaption and the user accepts the highest monitor setup setting (which may be below the optimal setting) that "appears okay."

In a first aspect of the invention, a method is provided for performing calibration of display signals transmitted to a computer monitor by a host computer via an analog monitor interconnect. The method includes transmitting display signals to the monitor via the analog monitor interconnect; transmitting with the display signals, via the analog monitor interconnect, a plurality of signals forming reference signal patterns; and receiving at the computer monitor, the display signals and the reference signal patterns and adjusting the display signals based on a detected deviation of the received reference signal patterns from control values.

In a second aspect of the invention, a computer monitor is provided for receiving analog display signals and multiplexed reference signal patterns over an analog monitor interconnect. The monitor includes signal comparison circuitry for receiving analog signals forming the reference signal patterns at predetermined time periods during normal operation of the computer monitor and comparing the received reference signal patterns with control values. Signal adjustment means are provided, and configured to adjust the analog display signals based on a detected deviation of the received reference signal patterns from the control values.

In a third aspect of the invention, a display adaptor provides communication between a host computer and a computer monitor over a monitor interconnect. The display adaptor includes a graphics controller for generating digital display data corresponding to an analog display signal; a reference signal pattern generator for receiving signals from the graphics controller and combining therewith digital data corresponding to reference signal patterns; and a digital-to-analog conversion device for receiving the digital data corresponding to the display signal and the reference signal patterns, and outputting based thereon an analog signal comprising the display signal and the reference signal patterns.

In a fourth aspect of the invention, a computer apparatus includes a computer device and a computer monitor interconnected with the computer device via an analog monitor interconnect. The computer device includes a graphics controller for generating digital display data corresponding to a display signal, a reference signal pattern generator for receiving signals from the graphics controller and combining therewith digital data corresponding to reference signal patterns, and a digital-to-analog conversion device for receiving the digital data corresponding to the display signal and the reference signal patterns, and outputting based thereon an analog signal comprising the display signal and the reference signal patterns. The computer monitor includes signal comparison circuitry for receiving analog signals forming the reference signal patterns at predetermined time periods during normal operation of the computer monitor, and comparing the received reference signal patterns with control values; and adjustment means configured to adjust the analog display signals based on a detected deviation of the received reference signal patterns from the control values.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
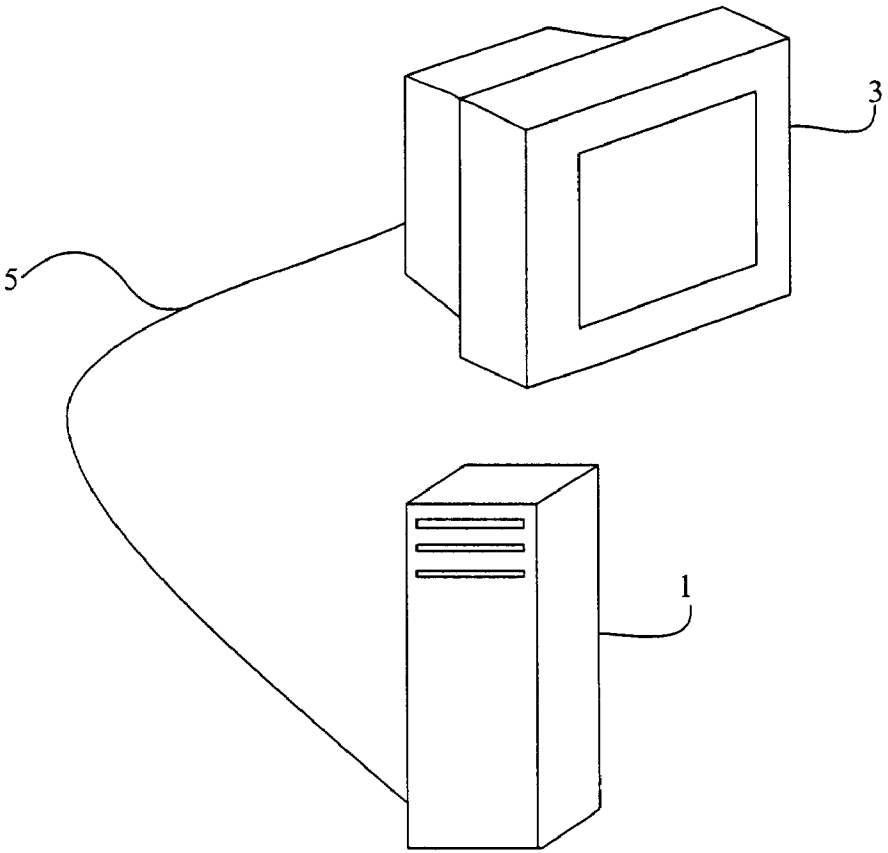
Fig. 1 Prior Art
FIG. 1 is a simplified perspective view of a host personal computer and CRT display monitor, interconnected by a cable with a standard (e.g., VGA) connector form factor.
Figure 2:
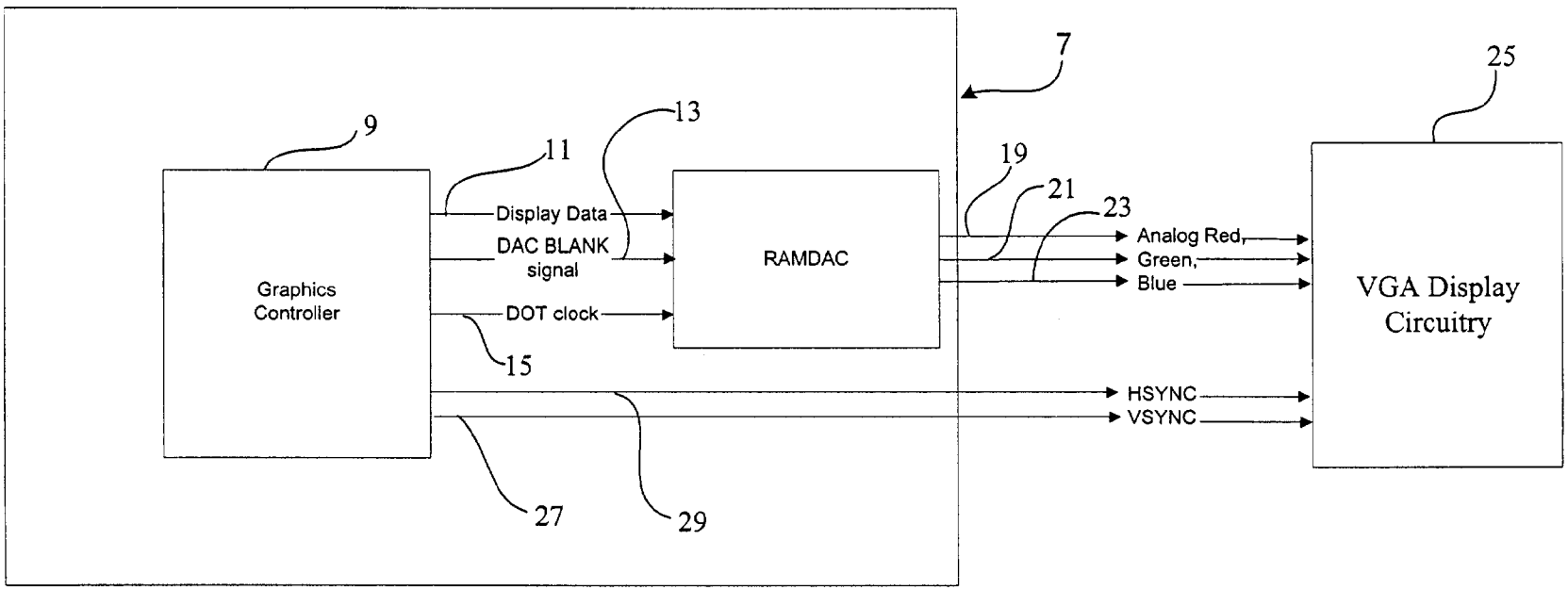
Fig. 2 Prior Art
FIG. 2 is a functional block diagram of a prior art display adaptor, included as part of the host PC illustrated in FIG. 1, display circuitry of the illustrated computer monitor, and signal lines of the illustrated standard (e.g., VGA) interconnect.
Figure 3:
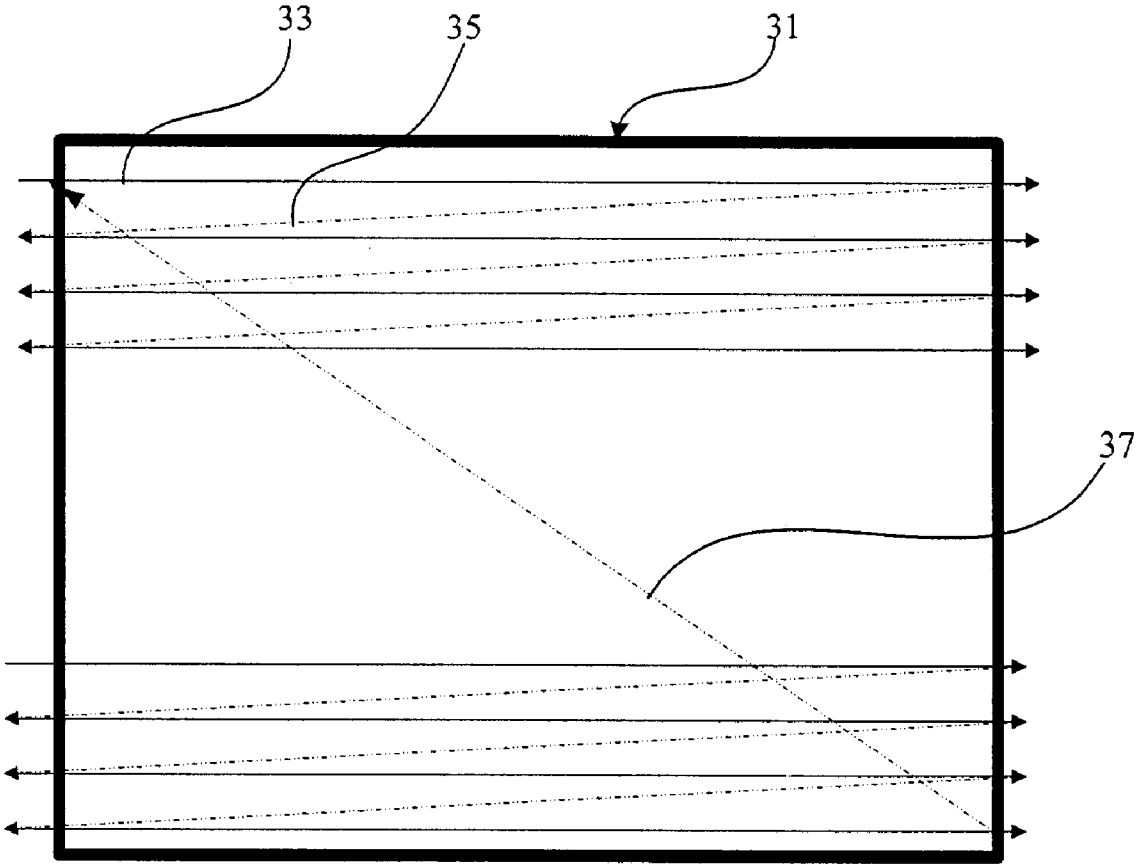
Fig. 3 Prior Art
FIG. 3 is a diagrammatic illustration of a raster scan of a conventional CRT computer monitor.
Figure 4:
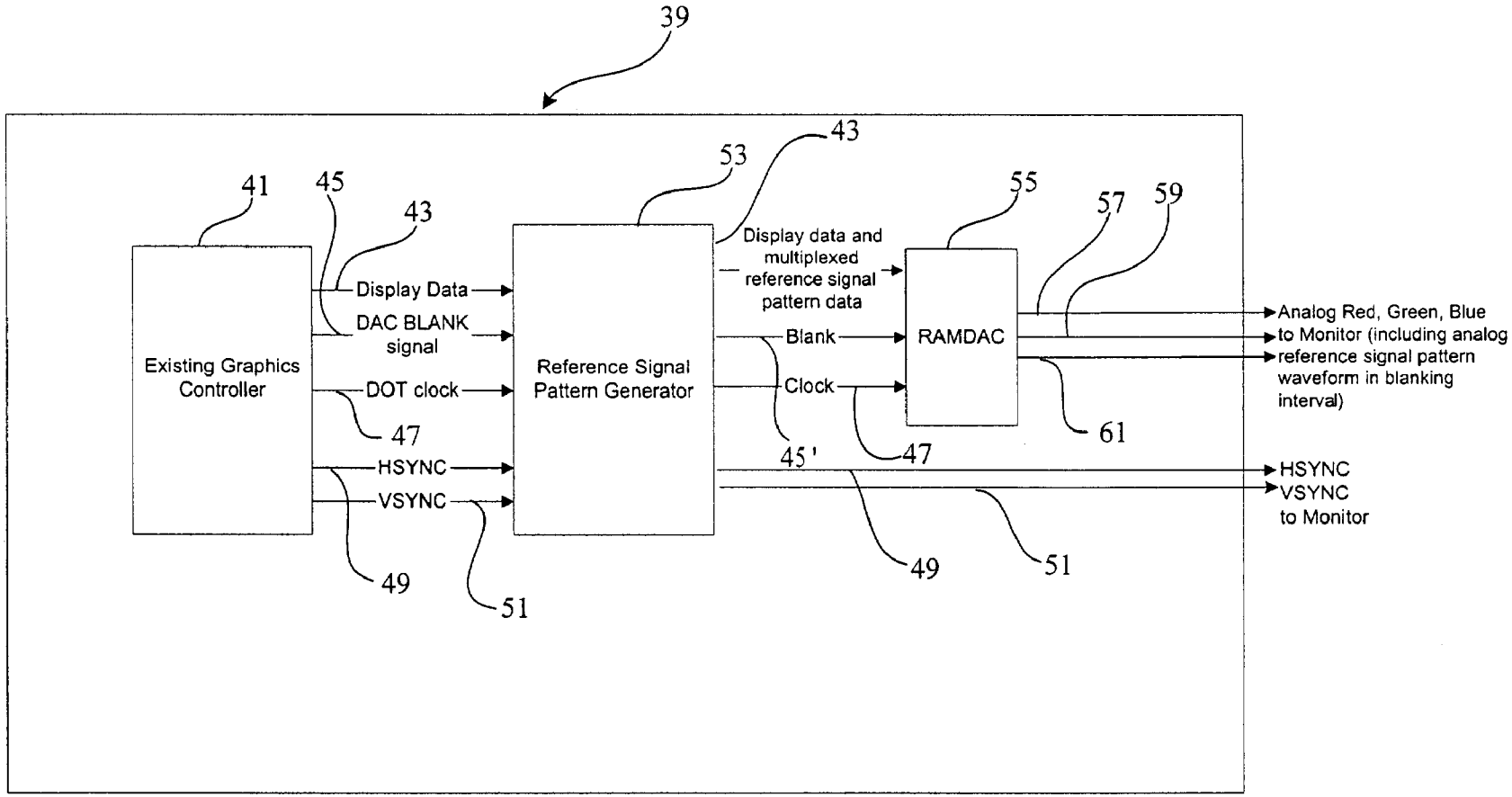
FIG. 4 is a functional block diagram of a modified display adapter in accordance with the invention.

Referring to FIG. 4, a modified display adapter 39, e.g., a modified VGA display adapter, may be provided as part of an otherwise conventional host computer, e.g., a desktop PC 1 (as shown in FIG. 1). Modified display adaptor 39 includes an existing graphics controller 41 which provides digital display data 43, a DAC blank signal 45, a DOT clock pulse 47, and synch pulses HSYNC 49 and VSYNC 51, to circuitry comprising a reference signal pattern generator 53. Reference signal pattern generator 53 multiplexes into digital display data 43 digital reference signal pattern data as will be described.

In a preferred embodiment, the digital reference signal pattern data is injected into the digital data stream at Horizontal retrace locations during the vertical blanking interval (VBI). Reference signal pattern generator 53 utilizes HSYNCH and VSYNCH signals 49, 51 to determine the synchronization for injection of the reference signal pattern data, and passes the synch pulse signals on unaltered for output to a monitor (e.g., a VGA monitor via a standard VGA interconnect). Reference signal pattern generator 53 uses the DOT clock signal 47 for timing the duration of the calibration signals and, when injecting the calibration signals, suppresses the DAC blank signals 45 to RAMDAC 55. This may be accomplished by outputting to RAMDAC 55 a modified blank signal 45' that causes RAMDAC 55 to pass signal data during those portions of the VBI used to transmit reference signal pattern data. Reference signal pattern generator 53 passes to RAMDAC 55 the data stream comprising the multiplexed digital display data and reference signal pattern data. RAMDAC 55 translates the incoming digital display data and reference signal pattern data to corresponding digital color values, and performs digital-to-analog signal conversion of those digital color values, e.g., by comparison of the digital color values with a look-up table including matching voltage levels for the three primary colors (R, G and B) needed to create the color of a single pixel. RAMDAC 55 thus provides as its output analog R, G and B signals 57, 59, 61 including predetermined signal pattern waveforms in the VBI.

In the illustrated embodiment, reference signal pattern generator 53 provides digital signal patterns to RAMDAC 55, such that RAMDAC 55 produces analog reference signal patterns multiplexed with the analog R, G and B data (waveforms). In the illustrative embodiment, the reference signal patterns are presented onto the signal during Horizontal retraces (i.e. "lines") during the VBI. Table 1 (below) provides an example of fourteen analog reference signal patterns that may be sent to a monitor on 14 Horizontal retrace lines during VBI. In the example, a particular (single) reference signal pattern is sent in each line. Of course, different reference signal patterns, and a greater or smaller number of lines during the VBI may be used. As an alternative (or addition), multiple reference signal patterns may be sent during one of the horizontal blanking intervals, although flexibility in this case is limited given the relatively shorter period of this interval due to the time needed for the received signals to "settle" and the receive circuitry to measure the received signal.

TABLE 1

| Procedure | Drive signal | Timing | Measure |
|---|---|---|---|
| Black level analog signal compensate | R, G, B to black level | During Vertical retrace back porch at 1st line, drive with trailing edge of HSYNC [Horizontal Synchronization signal] for one line | 0.000 volts at monitor R, G, B receivers (Adjust black offset) |
| Mid-level analog signal compensate | R, G, B to mid-level | During Vertical retrace back porch at 2nd line, drive with trailing edge of HSYNC for one line | 0.350 volts at monitor R, G, B receivers. (Adjust gain) |
| White level analog signal compensate | R, G, B to full level | During Vertical retrace back porch at 3rd line, drive with trailing edge of HSYNC for one line | 0.700 volts at monitor R, G, B receivers. (Adjust gain) |
| Digital signal to analog signal skew<br><br>Analog signal fall time | Drive R to from full level to black level within one DOT clock | During Vertical retrace back porch at 4th line, drive concurrent with trailing edge of HSYNC for one line | HSYNC trailing edge to R signal skew. Measure R signal "back level" value. (Adjust timing skew, determine signal bandwidth.) |
| Digital signal to analog signal skew<br><br>Analog signal rise time | Drive R to from black level to full level within one DOT clock | During Vertical retrace back porch at 5th line, drive concurrent with trailing edge of HSYNC | HSYNC trailing edge to R signal skew. Measure R signal "full scale" value. (Adjust timing skew, determine signal bandwidth.) |
| Analog signal falling skew | Drive R, G, B to from full level to black level within one DOT clock | During Vertical retrace back porch at 6th line, drive concurrent with trailing edge of HSYNC | HSYNC trailing edge to each R, G, B. Compare R, G, B simultaneous sampled values. (Adjust timing skew, determine signal bandwidth.) |
| Analog signal rising skew | Drive R, G, B from black level to full level within one DOT clock | During Vertical retrace back porch at 7th line, drive concurrent with trailing edge of HSYNC | HSYNC trailing edge to each R, G, B. Compare R, G, B simultaneous sampled values. (Adjust timing skew, determine signal bandwidth.) |
| Single falling driver crosstalk | Drive R from full level to black level while G, B are at full level within one DOT clock | During Vertical retrace back porch at 8th line, drive with trailing edge of HSYNC | Measure crosstalk on G and B signals. (Determine signal bandwidth and filtering.) |
| Drive all signals to full level | Drive R, G, B to full level | During Vertical retrace back porch at 9th line, drive with trailing edge of HSYNC | na |
| Dual falling driver crosstalk | Drive R, B from full level to black level while G is at full level within one DOT clock | During Vertical retrace back porch at 10th line, drive with trailing edge of HSYNC | Measure crosstalk on G signal. (Determine signal bandwidth and filtering.) |

TABLE 1-continued

| Procedure | Drive signal | Timing | Measure |
|---|---|---|---|
| Drive all signals to black level | Drive R, G, B to black level | During Vertical retrace back porch at 11th line, drive with trailing edge of HSYNC | na |
| Single rising driver crosstalk | Drive R from black level to full level while G, B are at black level within one DOT clock | During Vertical retrace back porch at 12th line, drive with trailing edge of HSYNC | Measure crosstalk on G and B signals. (Determine signal bandwidth and filtering.) |
| Drive all signals to black level | Drive R, G, B to black level | During Vertical retrace back porch at 13th line, drive with trailing edge of HSYNC | na |
| Dual rising driver crosstalk | Drive R, B from black level to full level while G is at black level within one DOT clock | During Vertical retrace back porch at 14th line, drive with trailing edge of HSYNC | Measure crosstalk on G signal. (Determine signal bandwidth and filtering.) |

The reference signal patterns generated by reference signal pattern generator 53, and converted to analog signals by RAMDAC 55 of display adaptor 39, are received by signal comparison circuitry 63 of modified monitor display circuitry 25' (FIG. 5) over a standard (e.g., VGA) monitor interconnect. Signal comparison circuitry 63, which may comprise analog circuitry, an application specific integrated circuit, and/or a general purpose processor operating under the control of firmware or software, is programmed or otherwise configured to compare the received references signal patterns with control values associated with corresponding times or intervals, e.g., 0 volts at the first line of the VBI (when each of the R, G and B signals are driven to the black level). To the extent that there is deviation from the expected (control) values, which may occur due to the limitations of the standard monitor interconnect, calibration may be performed by making suitable adjustments to the display signals prior to passing the display signals on to existing monitor display circuitry 65. This process is described in more detail below, with reference to the exemplary reference signal patterns of foregoing Table 1.

Figure 5:
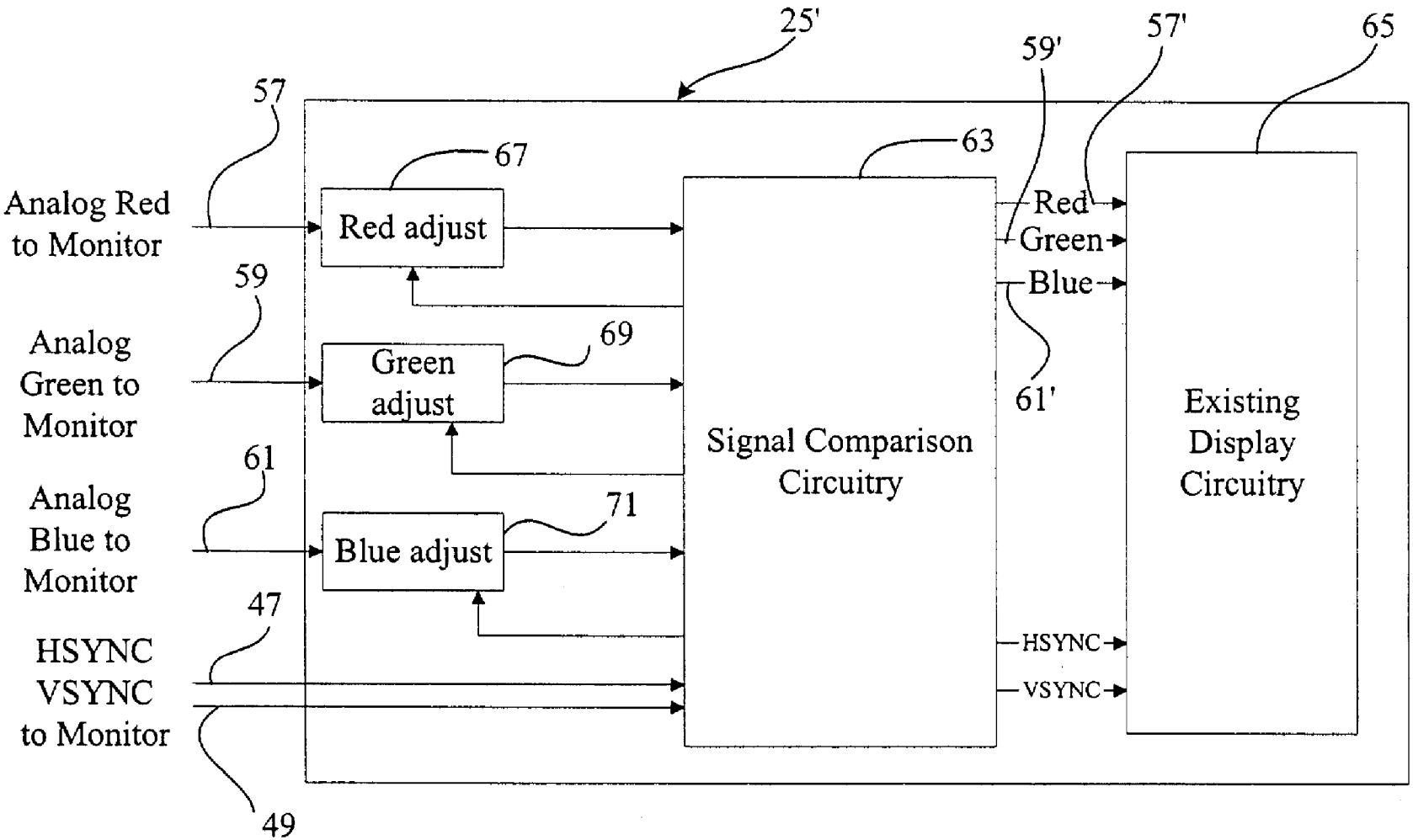
FIG. 5 is a functional block diagram of modified computer display monitor circuitry in accordance with the invention, for receiving signals from the display adaptor of FIG. 4.

As seen in FIG. 5, modified monitor display circuitry 25' comprises signal comparison circuitry 63, along with signal adjustment circuit blocks 67, 69 and 71 for the R, G and B signals, respectively. Each of the adjustment blocks may include circuitry for effecting adjustments to the received signals, e.g., equalization, gain, phase, matching and termination impedance adjustments. Comparison circuitry 63 receives the red, green and blue analog display signals 57, 59, 61 and compares, during predetermined blanking intervals (e.g., lines of the VBI), detected parameters of these signals, e.g., voltages, phases and spectra, to the pre-programmed/set control values. Since the reference signal patterns are transmitted during a blanking interval (e.g., the VBI), the output display remains unaffected. Signals derived from the comparisons are fed back to signal adjust blocks 67, 69 and 71 to adjust the respective R, G and B signals based on the detected deviation. This arrangement of the illustrated embodiments provides a "slow" closed feedback loop, since the adjustments are done after the measurements are made, and the need for further adjustments is not determined until the next VBI (e.g., every 1/60 of a second. Signal comparison circuitry 63 provides the adjusted (as needed) R, G and B signals 57', 59' and 61' to existing display circuitry 65, and passes on the HSYNCH and VSYNCH signals as well. Comparison circuitry 63 uses HSYNC and VSYNC to determine which of the 14 signal calibration patterns are being sent; specifically, the trailing edge of HSYNC preferably is used as a common timing reference point for measurements. Circuitry 63 will also internally "blank" signals 57', 59', and 61' output to the existing display circuitry 65 during those portions of the VBI when the signal calibration patterns are being sent, so that the patterns do not adversely affect the appearance of the displayed image appearing on the monitor screen. In a preferred embodiment, circuitry 63 will internally "blank" signals 57', 59', and 61' output to the display circuitry for 14 horizontal retraces during the VBI.

With reference to Table 1, during calibration in the illustrative embodiment, reference signal pattern generator 53 generates digital signals that cause RAMDAC 55 to drive the R, G and B signals to the black level during the vertical retrace back porch (VBI) at the first line. The signals are driven to black (0 volts) at the trailing edge of HSYNC for a time period of one line, and are output over the monitor interconnect. The monitor receives the R, G and B signals and compares the received signals to the expected (comparison) value of the signals, 0 volts. If any of the signals do not agree with the expected values, the black offsets of the signals are adjusted, by adjust blocks 67, 69 and 71, as necessary. For example, if during line 1 a received black offset is 0.02 volts, the signal offset will be adjusted such that the signal output by signal comparison circuitry 63 to display circuitry 65 is 0 volts for an input voltage of 0.02 volts.

During the vertical retrace back porch (VBI) at the second line, reference signal pattern generator 53 outputs signals to cause RAMDAC 55 to drive the R, G and B signals to a mid-level (0.350 volts) with the trailing edge of HSYNC, for a time period of one line. The monitor receives the R, G and B signals and compares the received signals to the expected value of the signals, 0.350 volts. If any of the signals do not agree with the expected value, the gain of the signal(s) is adjusted accordingly.

During the vertical retrace back porch (VBI) at the third line, reference signal pattern generator 53 outputs signals to cause RAMDAC 55 to drive the R, G and B signals to a full (white) level (0.700 volts) with the trailing edge of HSYNC, for an interval of one line. The monitor receives the R, G and B signals and compares the received signals to the expected value of the signals, 0.700 volts. If any of the signals do not agree with the expected values, the gain of the signal(s) is adjusted accordingly.

During the vertical retrace back porch (VBI) at the fourth line, reference signal pattern generator 53 outputs signals to cause RAMDAC 55 to drive the full-level R signal (0.700 volts) down to black level within one DOT clock time period, concurrent with the trailing edge of HSYNCH. The monitor receives the R, G and B signals, and measures the HSYNC trailing edge to R signal skew. The timing skew is adjusted accordingly and the signal bandwidth is determined. As used here, "bandwidth" refers to usable display information carrying capacity of the signal received by the monitor over the monitor interconnect, which is directly related to the attainable monitor resolution. Signal bandwidth is approximately inversely proportional to the signal edge rate (the signal rise/fall time). This approximation is derived from a Fourier analysis of the signal waveform. Basically, the faster the signal switches, the higher the frequency content (and information carrying capacity) of the signal.

During the vertical retrace back porch (VBI) at the fifth line, reference signal pattern generator 53 outputs signals to cause RAMDAC 55 to drive the black-level R signal (0.000 volts) to full level (0.700 volts) within one DOT clock time period, concurrent with the trailing edge of HSYNCH. The monitor measures the HSYNC trailing edge to R signal skew. The timing skew is adjusted accordingly and the signal bandwidth is determined.

During the vertical retrace back porch (VBI) at the 6th line, reference signal pattern generator 53 outputs signals to cause RAMDAC 55 to drive the R, G and B signals, at the HSYNC trailing edge, from full level to black level within 1 DOT clock time period. The monitor compares the simultaneously sampled R, G and B values, and if the timing of the change of any of the R, G and B signals do not occur concurrently, the timing skew of the signal(s) is adjusted; in addition, signal bandwidth is determined.

During the vertical retrace back porch (VBI) at the seventh line, analog signal rising skew is measured when reference signal generator 53 causes RAMDAC 55 to drive the R, G and B signals from black level to full level within one DOT clock time period, concurrent with the trailing edge of HSYNCH. The monitor compares simultaneously sampled R, G and B signals and if the timing of the change of any of the R, G and B signals do not occur concurrently, the timing skew of the signal(s) is adjusted accordingly.

During the vertical retrace back porch (VBI) at the eighth line, with the trailing edge of HSYNC, reference signal pattern generator 53 outputs signals to cause RAMDAC 55 to drive the R signal from full level to black level within one DOT clock time period, while the G and B signals are maintained at full level. Crosstalk on the G and B signals is measured and signal bandwidth and filtering are determined. A low-pass filter can be applied to reduce high frequency cross talk, or signal termination can be adjusted to reduce the cross-talk. In this measurement, the G and B signals should experience minimal cross-talk noise. If this noise is measured, then filtering or termination can be applied/adjusted on all the R,G and B signals.

During the vertical retrace back porch (VBI) at the ninth line, with the trailing edge of HSYNC, reference signal pattern generator 53 outputs signals to cause RAMDAC 55 to drive the R, G and B signals to full level, to preset the signal levels for calibration during the next (tenth) line.

During the vertical retrace back porch (VBI) at the tenth line, with the trailing edge of HSYNC, reference signal pattern generator 53 outputs signals to cause RAMDAC 55 to drive the R and B signals from full level to black level within one DOT clock time period, while G is maintained at full level. Crosstalk on the G signal is determined based on the deviation of the actual G signal from its comparison value, and signal bandwidth and filtering are determined. A low-pass filter can be applied to reduce high frequency cross talk, or signal termination can be adjusted to reduce the cross-talk. In this measurement, the G signal should experience minimal cross-talk noise. If this noise is measured, then filtering or termination can be applied/adjusted on all the R, G and B signals.

During the vertical retrace back porch (VBI) at the eleventh line, with the trailing edge of HSYNC, reference signal pattern generator 53 outputs signals to cause RAMDAC 55 to drive the R, G and B signals to black level, to preset signal levels for calibration to be performed during the next (twelfth) line.

During the vertical retrace back porch (VBI) at the twelfth line, with the trailing edge of HSYNC, reference signal pattern generator 53 outputs signals to drive RAMDAC 55 to drive the R signal from black level to full level within one DOT clock time period, while G and B are maintained at the black level. Crosstalk on the G and B signals is determined based on the deviation of the G and B signals from their comparison values, and signal bandwidth and filtering are determined. A low-pass filter can be applied to reduce high frequency cross talk, or signal termination can be adjusted to reduce the cross-talk. In this measurement, the G and B signals should experience minimal cross-talk noise. If this noise is measured, then filtering or termination can be applied/adjusted on all the R, G and B signals.

During the vertical retrace back porch (VBI) at the thirteenth line, with the trailing edge of HSYNC, reference signal pattern generator 53 outputs signals to cause RAMDAC 55 to drive the R, G an B signals to black level, to preset the signal levels for calibration to be performed during the next (fourteenth) line.

During the vertical retrace back porch (VBI) at the fourteenth line, with the trailing edge of HSYNC, reference signal pattern generator 53 outputs signals to cause RAMDAC 55 to drive the R and B signals from black level to full level while G is maintained at black level within one DOT clock time period. Crosstalk on the G signal is measured based on the deviation of the G signal from its comparison values, and signal bandwidth and filtering are determined. A low-pass filter can be applied to reduce high frequency cross talk, or signal termination can be adjusted to reduce the cross-talk. In this measurement, the G signal should experience minimal cross-talk noise. If this noise is measured, then filtering or termination can be applied/adjusted on all the R, G and B signals.

In a further aspect of the invention, the host computer may query its attached monitor to determine if the monitor is capable of performing the inventive calibration that has been described. This may be performed by the host computer querying the monitor for Extended Displaying Identification Data (EDID). If the monitor is capable, then the host computer can optionally notify the display that it will be sending signal calibration signals during VBI. The host computer can communicate to the monitor via Display Data Channel/Command Interface (DDC/CI) signaling, as is well-known in the art and defined by the Video Electronics Standards Association (VESA). It is not a requirement that the host so notify the monitor. Rather, it is contemplated that a monitor capable of performing the inventive calibration be configured to perform internal display blanking during the VBI automatically (e.g., as a default setting). In the described preferred embodiment, internal display blanking would automatically occur for the first 14 horizontal retrace lines during the VBI.

Figure 6:
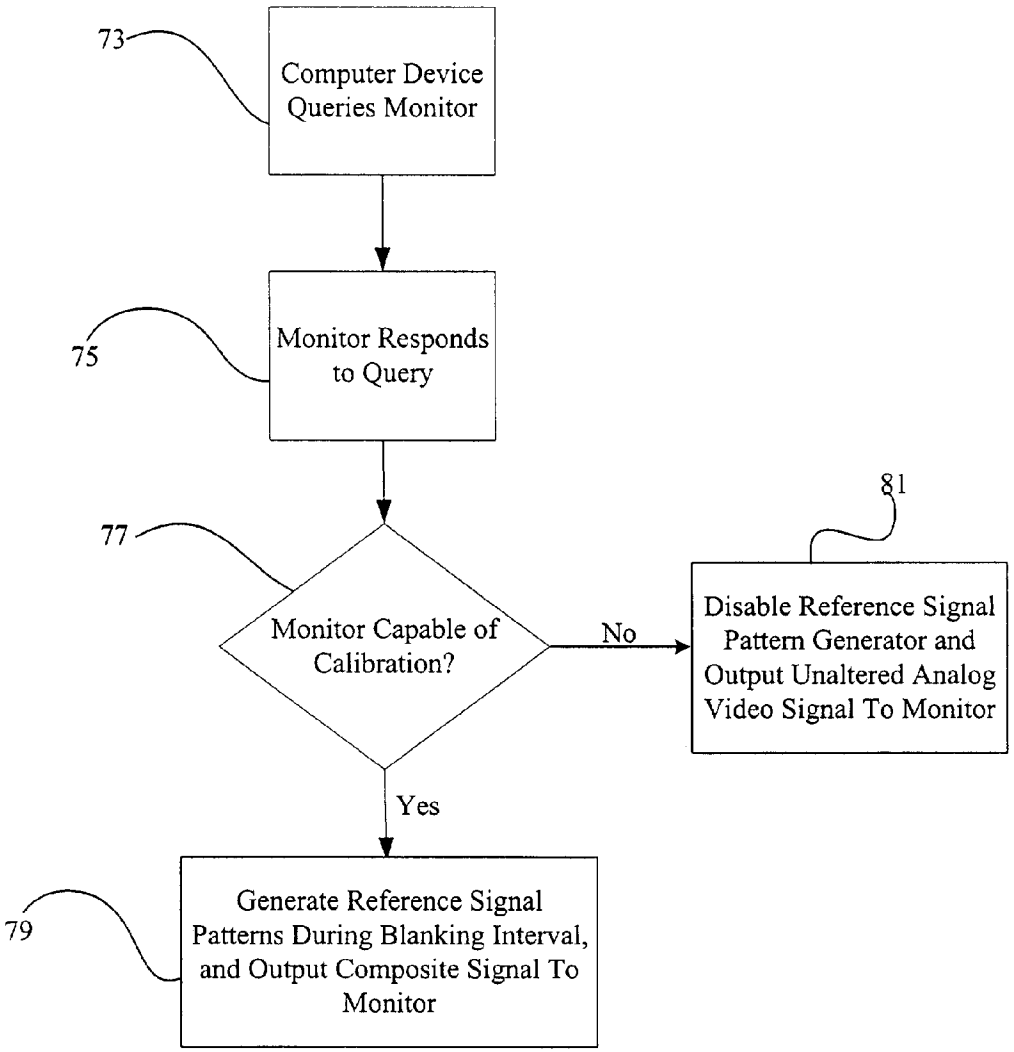
FIG. 6 is a flowchart illustrating a process in accordance with the invention for querying a computer monitor to determine calibration capability, and initiating the inventive calibration upon detecting such capability.

FIG. 6 is a flowchart illustrating an exemplary process for querying a monitor to determine its capability (set-up) to carry-out calibration in accordance with the present invention. At step 73, the host computer sends a query to a connected monitor. At step 75, after receiving a query, the monitor responds to the query by sending information (e.g., EDID data) to the host computer. At step 77, the computer device receives and reads the information to determine whether the connected monitor is equipped to perform the inventive calibration. When the monitor is determined to be capable of performing such calibration, a message to this effect is generated and such calibration is initiated, at step 74, by the generation of reference signal patterns during a blanking interval, for output to the monitor with the analog display data. In the event that the monitor is not equipped to carry-out such calibration, a message to this effect may be generated, which may be used to disable operation of reference signal pattern generator 53 (step 81), whereupon modified display adaptor 39 may operate in a conventional manner.

Aspects of the present invention have been described in terms of various illustrative embodiments. Numerous other embodiments, modifications and variations within the scope and spirit of the appended claims will occur to persons of ordinary skill in the art from a review of this disclosure.

The invention claimed is:

1. A method of performing calibration of display signals transmitted to a computer monitor by a host computer via an analog monitor interconnect, the method comprising:

transmitting display signals to the monitor via the analog monitor interconnect;

querying the computer monitor to determine if it is configured to perform calibration based on received reference signal patterns;

transmitting with said display signals, via the analog monitor interconnect, a plurality of signals forming reference signal patterns only when the computer monitor indicates that the computer monitor is configured to perform calibration based on received reference signal patterns; and receiving at the computer monitor the display signals and the reference signal patterns and adjusting the display signals based on a detected deviation of the received reference signal patterns from control values.

2. The method of claim 1, wherein said reference signal patterns are multiplexed with said display signals for transmission over said analog monitor interconnect.

3. The method of claim 2, wherein the predetermined time periods comprise blanking intervals of the display signals.

4. The method of claim 3, wherein the blanking intervals comprise vertical blanking intervals.

5. The method of claim 1, wherein the monitor interconnect is a VGA monitor interconnect.

6. A computer monitor for receiving analog display signals and multiplexed reference signal patterns over an analog monitor interconnect, the monitor comprising:

signal comparison circuitry for receiving analog signals forming said reference signal patterns at predetermined time periods during normal operation of the computer monitor, and comparing the received reference signal patterns with control values; and signal adjustment means configured to adjust said analog display signals based on a detected deviation of the received reference signal patterns from said control values, wherein the computer monitor is configured to respond to a query from a host computer, to indicate that it is configured to perform calibration based on received signal patterns.

7. The computer monitor of claim 6, wherein said reference signal patterns are multiplexed with said display signals for transmission over said analog monitor interconnect.

8. The computer monitor of claim 7, wherein the predetermined time periods comprise blanking intervals of the analog display signal.

9. The computer monitor of claim 8, wherein the blanking intervals comprise vertical blanking intervals.

10. The computer monitor of claim 6, wherein the monitor interconnect is a VGA monitor interconnect.

11. A display adaptor for providing communication between a host computer and a computer monitor over a monitor interconnect, the display adaptor comprising:

a graphics controller for generating digital display data corresponding to an analog display signal;

a reference signal pattern generator for receiving signals from the graphics controller and combining therewith digital data corresponding to reference signal patterns; and a digital-to-analog conversion device for receiving said digital data corresponding to said signal and said reference signal patterns, and outputting based thereon an analog signal comprising said display signal and said reference signal patterns, wherein said adaptor is configured to transmit a query to the computer monitor to determine if it is configured to perform calibration based on received signal patterns, and to receive a response from the computer monitor so indicating, and wherein said digital to analog conversion device outputs said analog signal upon receipt of a response from the computer monitor signaling the presence of a configuration for performing calibration based upon received signal patterns, and is disabled in the absence of such a signal.

12. The display adaptor of claim 11, wherein said reference signal patterns are located within a blanking interval of the analog display signal.

13. The display adaptor of claim 12, wherein the blanking interval comprises a vertical blanking interval of the analog display signal.

14. The display adaptor of claim 11, wherein said display adaptor is a VGA compatible display adaptor.

15. A computer readable medium having computer-executable instructions stored thereon for performing a method of calibrating display signals transmitted to a computer monitor by a host computer via an analog monitor interconnect comprising:

transmitting display signals to the monitor via the analog monitor interconnect;

querying the computer monitor to determine if it is configured to perform calibration based on received reference signal patterns;

transmitting with said display signals, via the analog monitor interconnect, a plurality of signals forming reference signal patterns only when the computer monitor indicates that the computer monitor is configured to perform calibration based on received reference signal patterns; and receiving at the computer monitor the display signals and the reference signal patterns and adjusting the display signals based on a detected deviation of the received reference signal patterns from control values.

16. The computer readable medium of claim 15 wherein said reference signal patterns are multiplexed with said display signals for transmission over said analog monitor interconnect.

17. The computer readable medium of claim 16, wherein the predetermined time periods comprise blanking intervals of the display signals.

18. The computer readable medium of claim 17, wherein the blanking intervals comprise vertical blanking intervals.

19. The computer readable medium of claim 15, wherein the monitor interconnect is a VGA monitor interconnect.

* * * * *